US007258338B2

(12) United States Patent
Lee et al.

(10) Patent No.: US 7,258,338 B2
(45) Date of Patent: Aug. 21, 2007

(54) MEDIA TRAY FOR IMAGE FORMING DEVICES

(75) Inventors: Hock Lim Lee, Singapore (SG); Thong Seng Wong, Singapore (SG); Shyun Long Wang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 548 days.

(21) Appl. No.: 10/860,820

(22) Filed: Jun. 3, 2004

(65) Prior Publication Data

US 2005/0269764 A1 Dec. 8, 2005

(51) Int. Cl.
*B65H 1/00* (2006.01)

(52) U.S. Cl. ..... 271/171

(58) Field of Classification Search ..... 271/145, 271/171

See application file for complete search history.

(56) References Cited

U.S. PATENT DOCUMENTS 5,313,257 A * 5/1994 Kashima et al. ..... 399/393
5,646,739 A * 7/1997 Kawai ..... 358/296
5,918,875 A * 7/1999 Masley et al. ..... 271/162
6,116,591 A * 9/2000 Kim ..... 271/171
6,338,585 B1 * 1/2002 Amano ..... 400/624
6,536,968 B2 * 3/2003 Lee et al. ..... 400/624
6,697,589 B1 * 2/2004 Dunning et al. ..... 399/122
6,869,071 B2 * 3/2005 Amamoto et al. ..... 271/145
7,097,172 B2 * 8/2006 Chang ..... 271/171
2003/0227127 A1 * 12/2003 Chang ..... 271/171
2004/0051231 A1 * 3/2004 Amamoto et al. ..... 271/145

FOREIGN PATENT DOCUMENTS

JP 2001225964 A * 8/2001

* cited by examiner

*Primary Examiner*—Patrick Mackey
*Assistant Examiner*—Michael C McCullough

(57) ABSTRACT

A media tray including a first tray portion that has a base, an outer wall that is fixed to the base, and a locking mechanism is disclosed. The locking mechanism is substantially fixed in position relative to the outer wall. The locking mechanism is biased to a locked position and actuatable, along an axis that is at least substantially perpendicular to a longitudinal axis of the outer wall, for moving the locking mechanism to an unlocked position.

13 Claims, 8 Drawing Sheets

MEDIA TRAY FOR IMAGE FORMING DEVICES

BACKGROUND

This invention relates to a media supply tray for use with image forming devices such as but not limited to photocopying machines, printers and facsimile machines.

Media trays of a telescopic design are known to be used for accommodating media stacks. The size of these media trays can be adjusted to support stacks of media of different sizes. A telescopic media tray typically includes a first tray portion that is coupled to a second tray portion. The first tray portion is moveable relative to the second tray portion to form a tray having an overall size that is variable depending on the position of the first tray portion relative to the second tray portion. To prevent media supported in the tray from being easily dislodged, the first tray portion is typically locked to the second tray portion after the first tray portion is adjusted to a selected position relative thereto. Media that is dislodged in the tray may result in skew, or worse, media jam when drawn into an image forming device.

A known locking mechanism used for locking the first tray portion to the second tray portion includes a right-angled lever that is pivoted to a sidewall of the first tray portion. The lever is tiltable about the pivot between a locked and an unlocked position. In the locked position, the lever engages one of a number of slots defined in the second tray portion to thereby lock the first tray portion in position relative to the second tray portion. Some users view such a locking mechanism as not very user-friendly because three separate actions are required to complete the adjustment of the first tray portion from one position to another relative to the second tray portion. The three separate actions are 1) unlocking the first tray portion by flipping the lever in one direction to an unlocked position, 2) grasping the first tray portion and moving it toward or away from the second tray portion, and 3) locking the first tray portion in position by flipping the lever in the other direction to the locked position. Thus, a media tray that is not as cumbersome to operate is desirable.

SUMMARY

According to an aspect of the present invention, there is provided a media tray including a base, an outer wall that is fixed to the base, and a locking mechanism. The locking mechanism is substantially fixed in position on the media tray relative to the outer wall. The locking mechanism is biased to a locked position and actuatable, along an axis that is at least substantially perpendicular to a longitudinal axis of the wall, for moving the locking mechanism to an unlocked position.

BRIEF DESCRIPTION OF DRAWINGS

Embodiments of the invention will be better understood with reference to the drawings, in which.

DETAILED DESCRIPTION

Generally, a media tray according to an embodiment includes a first tray portion that includes a base, an end or outer wall that is fixed to the base, and a locking mechanism. The locking mechanism is substantially fixed in position relative to the outer wall. The locking mechanism is biased to a locked position and actuatable, along an axis that is at least substantially perpendicular to a longitudinal axis of the outer wall, for moving the locking mechanism to an unlocked position. The first tray portion is coupleable to, for example, a second tray portion such that the first tray portion is moveable to one or more positions relative to the second tray portion. The second tray portion includes means for cooperating with the locking means to allow the locking of the first tray portion relative thereto.

When located sufficiently close to the outer wall, the locking mechanism is actuatable in a single grasping action with one hand when holding the outer wall with the same hand to move the first tray portion. In other words, a user may reach out and hold the tray with one hand, and in the same action of holding the outer wall simultaneously actuating the locking mechanism. Such a design of the tray is user-friendly.

Figure 1:
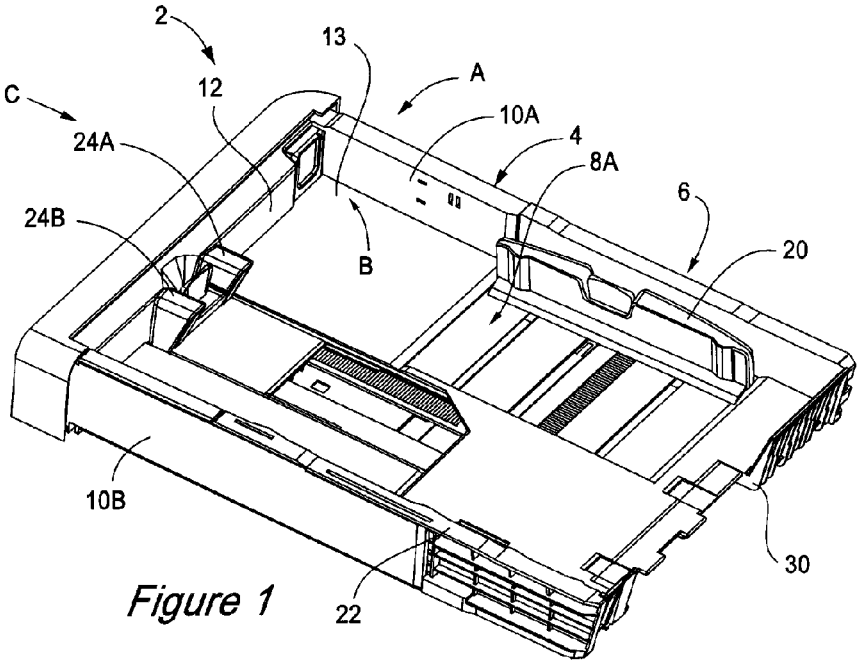
FIG. 1 is an isometric drawing of a tray, according to one embodiment of the invention, that includes a first tray portion that is moveable relative to a second tray portion, the first tray portion being shown moved to a first position next to the second tray portion for jointly defining an area for accommodating an A4-sized media stack.
Figure 2:
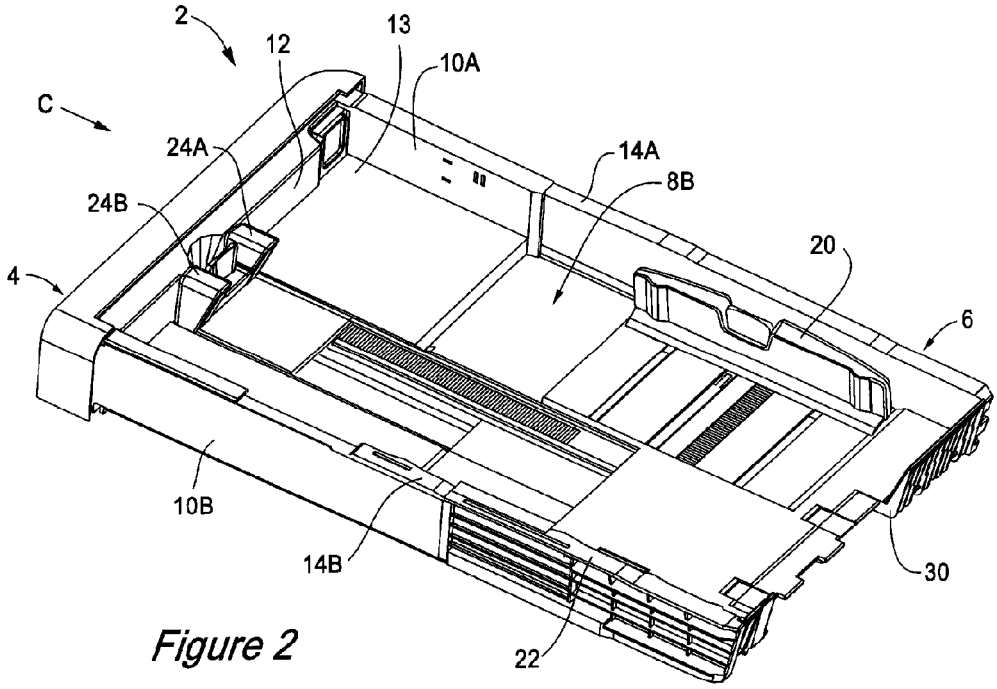
FIG. 2 is an isometric drawing of the tray in FIG. 1, wherein the first tray portion is shown moved to a second position further away from the second tray portion than when in its first position for jointly defining an area for accommodating a larger Legal-sized media stack.

FIGS. 1 and 2 are drawings of a telescopic tray 2, according to one embodiment, which includes a first tray portion 4 and a second tray portion 6. The first tray portion 4 is coupleable to the second tray portion 6. The first tray portion 4 is moveable towards and away from the second tray portion 6 to define an area 8A, 8B of a variable size therebetween for accommodating a stack of media (not shown) of a corresponding size. The first tray portion 4 is shown in FIG. 1 to be moved to a first closed position next to the second tray portion 6 for jointly defining a first area 8A for supporting or accommodating a small sized media stack, such as an A4-sized media stack, although stacks of other media sizes are possible. In FIG. 2, the first tray portion 4 is shown moved to a second extended position away from the second tray portion 6 for jointly defining a second area 8B, which is larger than the first area 8A, for accommodating a larger sized media stack, such as a Legal sized media stack, although stacks of other media sizes are also possible. In some embodiments, the first tray portion 4 is moveable to more than two predetermined positions relative to the second tray portion 6.

Referring to FIGS. 1 and 2, the first tray portion 4 has a pair of sidewalls 10A, 10B flanking an end or outer wall 12. These walls 10A, 10B, 12 are fixed to and extend from a base 13 of the first tray portion 4. The second tray portion 6 has a corresponding pair of guides 14A, 14B for receiving the sidewalls 10A, 10B of the first tray portion 4 to thereby allow the first tray portion 4 to be coupled therebetween and thus to the second tray portion 6. The first tray portion 4, or more specifically the sidewalls 10A, 10B thereof, are slideable along the guides 14A, 14B to allow the first tray portion 4 to be moved closer to and away from the second tray portion 6 as described above.

The second tray portion 6 supports a media edge guide 20 whose position on the second tray portion 6 is adjustable for varying the spacing between the media edge guide 20 and a sidewall 22 of the second tray portion 6. Similarly, the first tray portion 4 supports a pair of media end guides 24A, 24B which are fixed to the base 13 of the first tray portion 4. As the first tray portion 4 is moved relative to the second tray portion 6, the position of the media end guides 24A, 24B are adjusted with the first tray portion 4 for varying the spacing between the media end guides 24A, 24B and an end wall 30 of the second tray portion 6. The media edge guide 20 and the media end guides 24A, 24B define the boundaries of the stack of media supported by the tray 2 to ensure that they are correctly positioned in the tray 2 for receiving into an image forming device (not shown). During use, the tray 2 is received into an opening of the image forming device (not shown) with the end wall 30 being received into the opening first to be lodged against a media picking mechanism of the image forming device. When received in the image forming device, the outer wall 12 of the first tray portion 4 may remain accessible from outside of the device.

Figure 3:
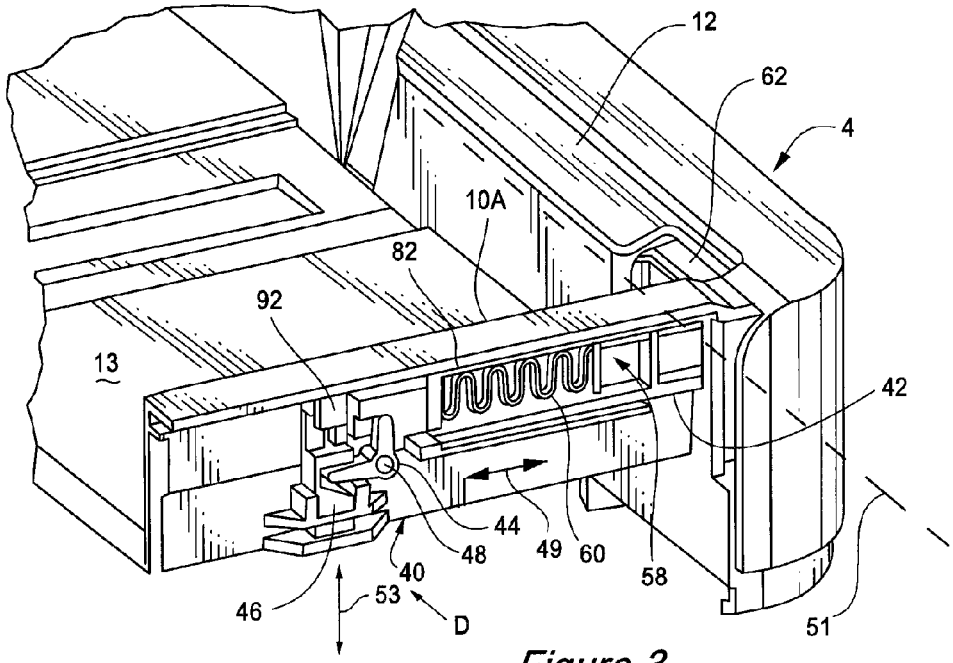
FIG. 3 is an isometric drawing of the first tray portion in FIG. 1 as seen in the direction of the arrow A shown in FIG. 1, showing a locking mechanism including an actuating arm, a lever member and a latch in a locked position, wherein the actuating arm and the latch is slidably mounted to a sidewall of the first tray portion.

FIG. 3 is a drawing of a portion of the first tray portion 4 in FIG. 1 as seen in the direction of the arrow A shown in FIG. 1, showing a locking mechanism 40 that is used to lock the first tray portion 4 in position after it has been moved to a desired position relative to the second tray portion 6. In this embodiment, the locking mechanism 40 includes an actuating arm 42, a lever member 44 and a latch 46. The actuating arm 42 is slidably mounted to the sidewall 10A of the first tray portion 4 to be moveable along a first movement axis 49 thereon between a retracted position and an extended position. This first movement axis 49 is at least substantially perpendicular to a longitudinal axis 51 of the outer wall 12. The lever member 44 is pivoted to the sidewall 10A via a pivot pin 48 and is rotatable thereabout for translating between the movement of the actuating arm 42 along the first movement axis and movement of the latch 46 in a second movement axis 53 transverse to the first movement axis 49. The first movement axis 49 may be perpendicular to the second move axis 53. In FIG. 3, the actuating arm 42 is shown biased to its extended position, wherein the latch 46 is accordingly biased via the lever member 44 to be in its locked position.

With such an arrangement, the locking mechanism 40 is substantially fixed in position on the first tray portion 4 relative to the outer wall 12. As the actuating arm 42 is moveable, along the first movement axis 49 that is at least substantially perpendicular to the longitudinal axis 51 of the outer wall 12, the locking mechanism 40 is thus actuatable in a single grasping action with one hand (not shown) when holding the outer wall 12 with that hand.

Figure 4:
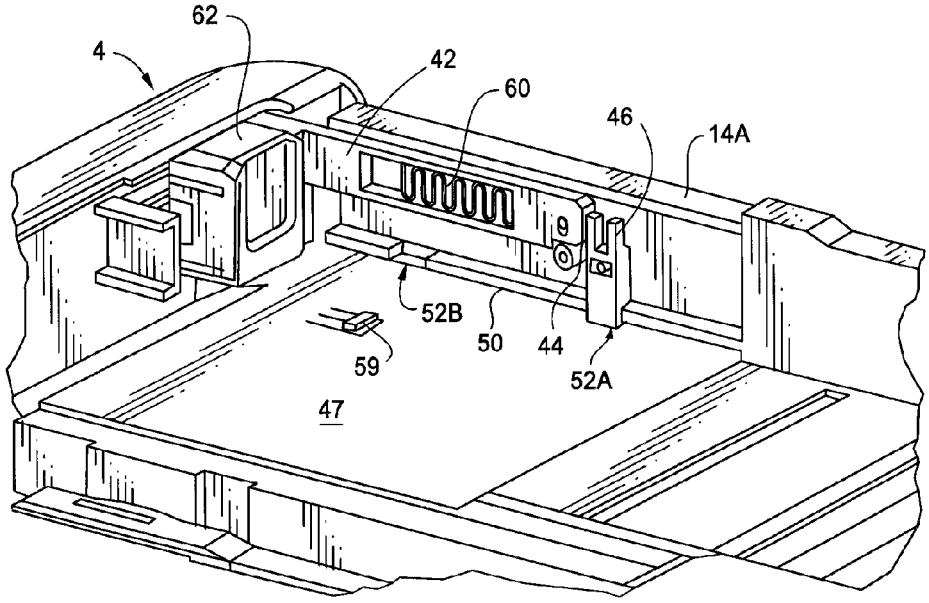
FIG. 4 is an isometric drawing of a portion of the tray in FIG. 1 as seen in the direction of the arrow B shown in FIG. 1, wherein the sidewall in FIG. 3 is not shown to allow an inward-facing side of the locking mechanism to be viewed, the latch being shown engaged in one of two notches formed in a rail of the second tray portion.

FIG. 4 is a drawing of a portion of the tray 2 in FIG. 1 as seen in the direction of the arrow B shown in FIG. 1, wherein the sidewall 10A and the base 13 in FIG. 3 are not shown in order to more clearly show an inwardly facing side of the actuating arm 42, the lever member 44 and the latch 46; and a base 47 of the second tray portion 6. FIG. 4 also shows means 52A, 52B for cooperating with the locking mechanism 40, in this case spaced-apart latch receiving means 52A, 52B, of the second tray portion 6 that receive the latch 46 of the locking mechanism 40 to thereby lock the first tray portion 4 to the second tray portion 6. In the embodiment in FIG. 4, the second tray portion 6 includes a rail 50 having, but not limited to, two notches 52A, 52B formed therein that function as the latch receiving means. The position of these notches 52A, 52B determines the position of the first tray portion 4 relative to the second tray portion 6. The latch 46 is shown received in a proximal one 52A of the two notches 52A, 52B to lock the first tray portion 4 in its first closed position immediately next to the second tray portion 6. The second tray portion 6 also includes a cantilevered locking member 59 on the base 47 of the second tray portion 6.

Figure 5:
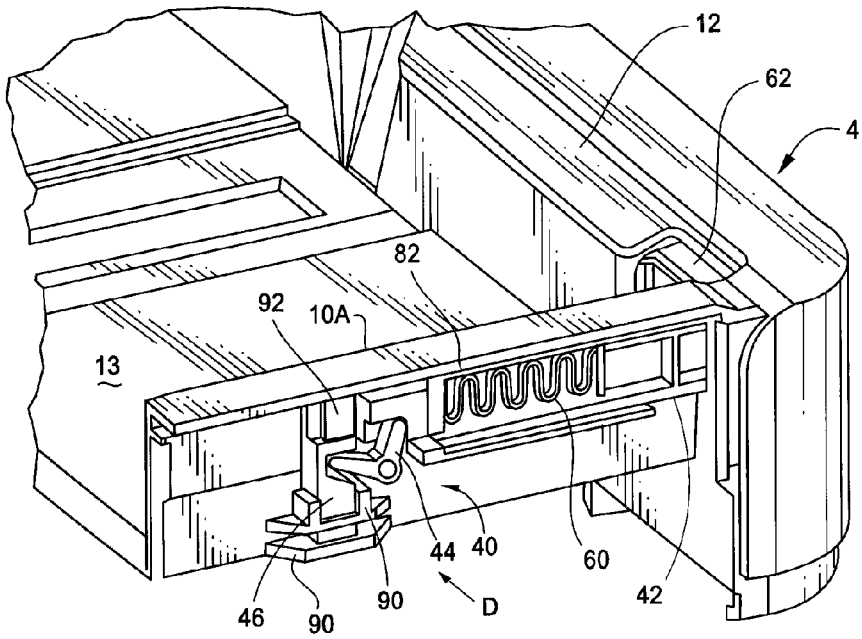
FIG. 5 is an isometric drawing similar to that in FIG. 3 with the actuating arm shown pulled away from the latch to move the latch clear of the notch to an unlocked position.
Figure 6:
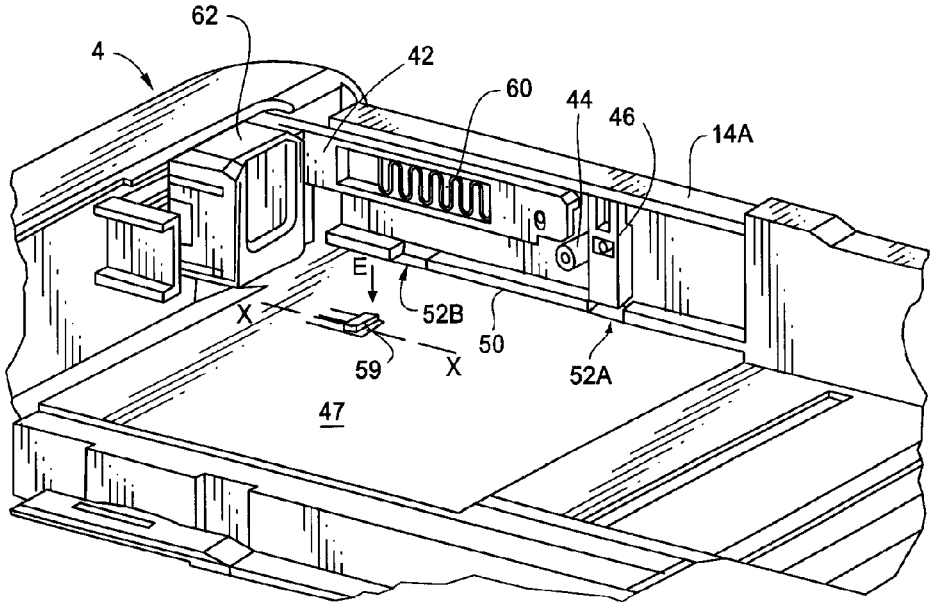
FIG. 6 is an isometric drawing similar to that in FIG. 4, with the latch shown in the unlocked position clear of the notch in the rail.

FIG. 5 is an isometric drawing similar to that in FIG. 3 with the actuating arm 42 shown actuated by pulling the actuating arm 42 away from the latch 46 to its retracted position. During pulling of the actuating arm 42, the lever member 44 accordingly rotates in the clockwise direction to lift or move the latch 46 clear of the notch 52A to an unlocked position as more clearly shown in FIG. 6. In this position, the first tray portion 4 is free to be moved by drawing the first tray portion 4 away from the second tray portion 6. With this particular embodiment, as soon as the latch 46 is moved to be disengaged from the notch 52B and the first tray portion 4 is drawn so that the latch 46 is at least partially above the rail 50, the locking mechanism 40 may be released to allow the actuating arm 42 to return to an extended position. However, since the rail 50 blocks the movement of the latch 46, the actuating arm 42 will remain in an intermediate position between the extended position and the retracted position. When the first tray portion 4 is drawn further away from the second tray portion 6 such that the latch 46 is directly above the second notch 52B, the latch 46 will be biased to the locked position once again to engage the second notch 52B.

Figure 7:
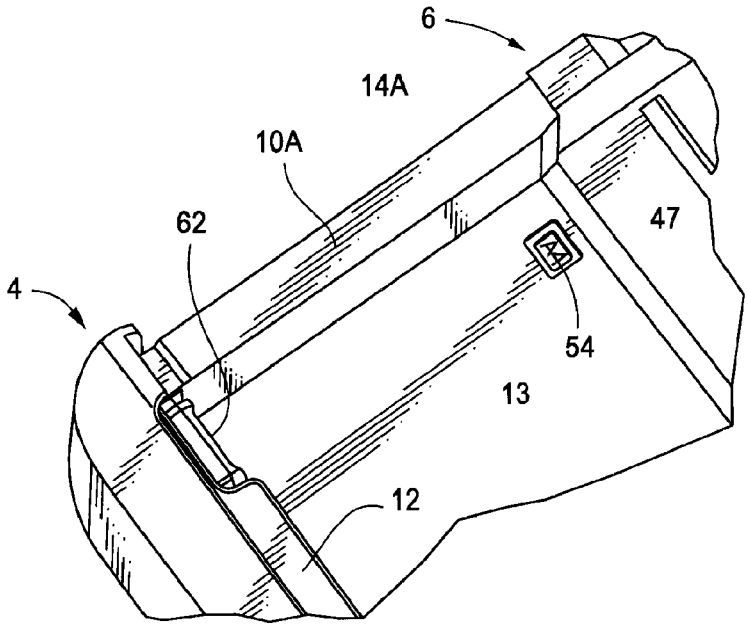
FIG. 7 is an isometric drawing of the tray in FIG. 1 as viewed in the direction of the arrow C shown in FIG. 1.
Figure 8:
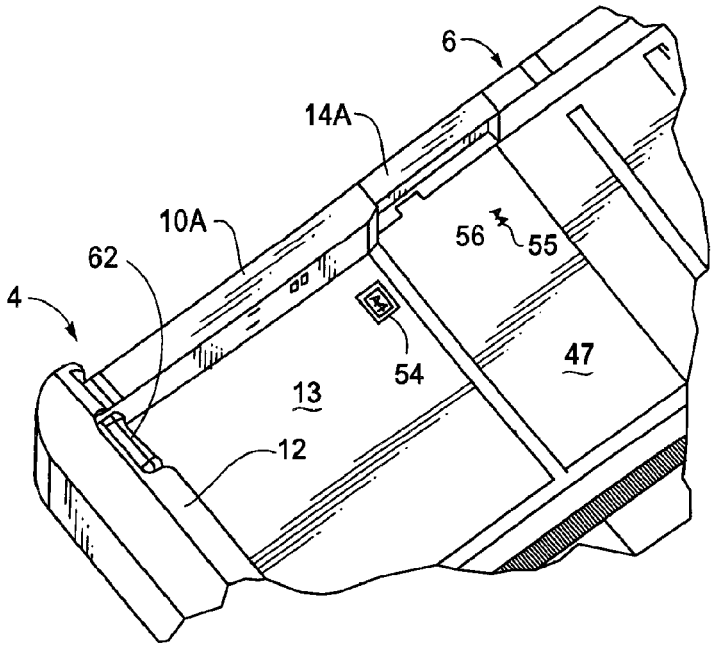
FIG. 8 is an isometric drawing of the tray in FIG. 2 as viewed in the direction of the arrow C shown in FIG. 2.

In some embodiments, such as those shown in FIGS. 7 and 8, the base 13 of the first tray portion 4 is provided with an opening 54 through which an indicium indicating the media size receivable in the tray is viewable. When the first tray portion 4 is in the closed position as shown in FIG. 7, with the latch 46 directly above the notch 52A, a first indicium 55 imprinted on the base 47 of the second tray portion 6 is viewable through the opening 54. When the first tray portion 4 is in the extended position as shown in FIG. 8, with the latch 46 directly above the notch 52B, a second indicium 56 is viewable through the opening 54. Alternatively or additionally, a detent (not shown) corresponding to the extended position of the first tray portion 4 may also be included in the tray 2 to provide a tactile feel when the first tray portion 4 is moved thereto. Such a detent is useful, especially when the first tray portion is moveable to several different positions relative to the second tray portion, for indicating to a user that the first tray portion 4 has been moved to a position for accommodating media of a particular size.

Figure 9:
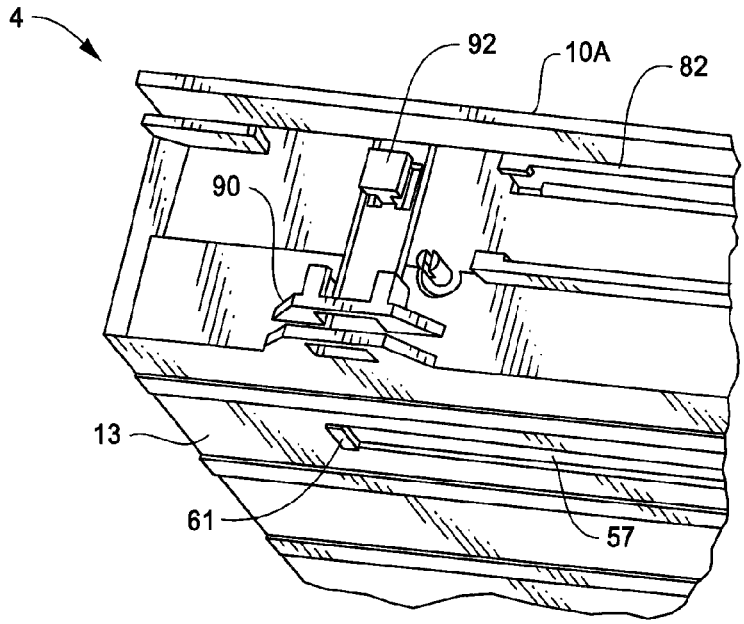
FIG. 9 is an isometric drawing of the first tray portion in FIGS. 3 and 5 as viewed in the direction of the arrow D shown in FIGS. 3 and 5, showing a groove formed in an undersurface of the first tray portion.
Figure 10:
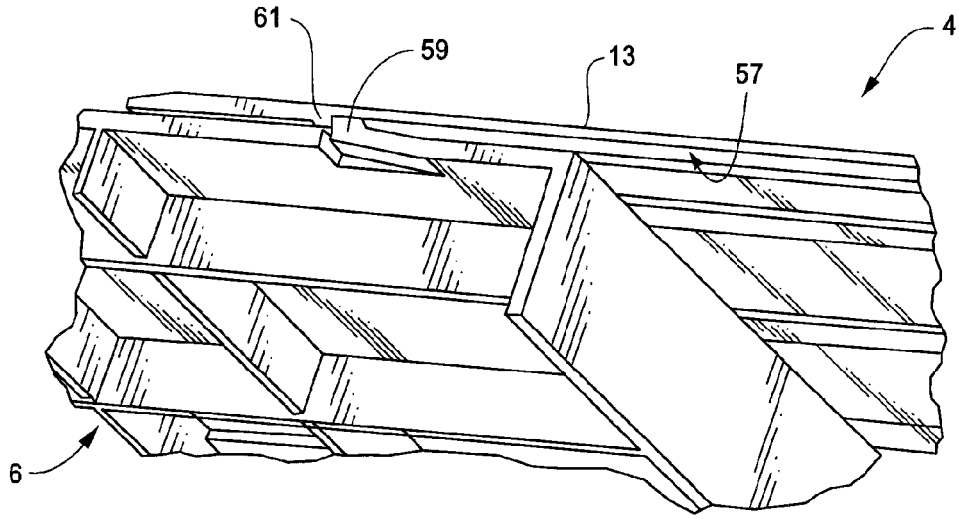
FIG. 10 is an isometric drawing of a section, taken along the line X-X shown in FIG. 6, of the second tray portion as viewed in the direction of the arrow E in FIG. 6, showing the second tray portion coupled to the first tray portion in a position where a locking member on a base of the second tray portion engages an end of the groove of the first tray portion in FIG. 9.

To prevent the first tray portion 4 from being separated from the second tray portion 6 when extending the first tray portion 4 beyond the extended position in FIG. 8, the first tray portion 4 includes a groove 57 (FIG. 9) in an undersurface of the base 13 for receiving the locking member 59 of the second tray portion 6. Between the closed position and the extended position of the first tray portion 4, the movement of the locking member 59 within the groove 57 is not impeded. However, when the first tray portion 4 is extended beyond the extended position, the locking member 59 abuts a protrusion 61 that extends from an end of the groove 57 as shown in FIG. 10. In this position, further extension of the first tray portion 4 is impeded to prevent the first tray portion 4 from being separated from the second tray portion 6.

Figure 11:
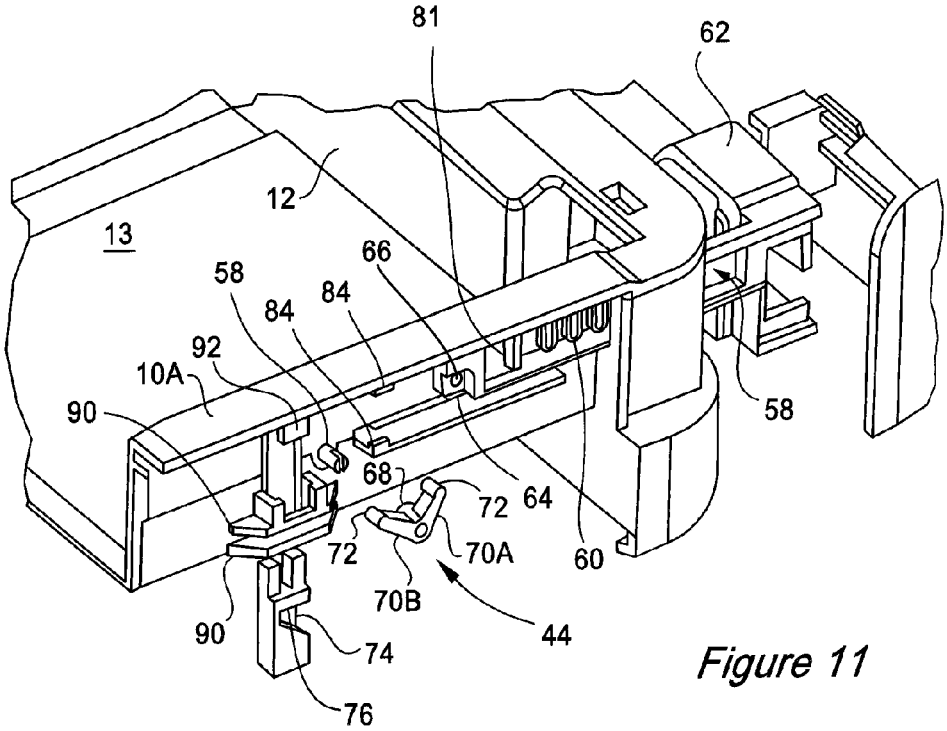
FIG. 11 is an exploded drawing of the first tray portion in FIGS. 3-6.
Figure 12:
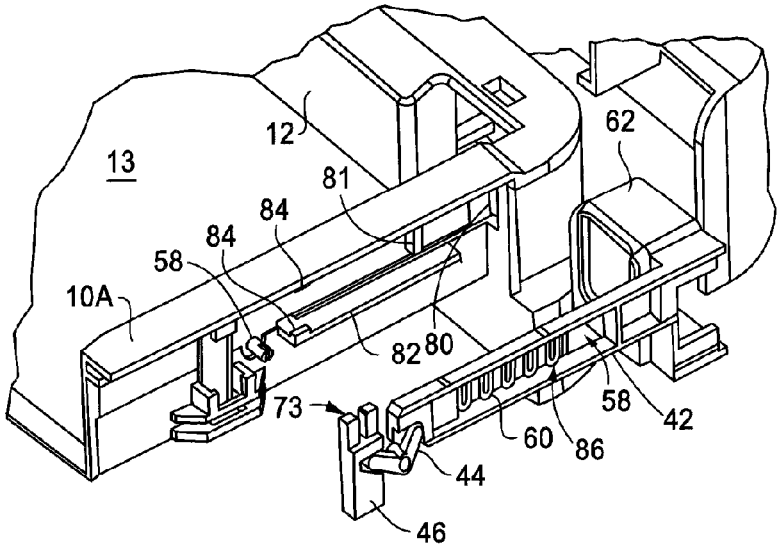
FIG. 12 is another exploded drawing of the first tray portion in FIGS. 3 and 5.

The locking mechanism 40 and the assembly thereof on the first tray portion 4 are now described in more detail with the aid of FIGS. 11 and 12. The actuating arm 42 has an elongated slot 58 formed therein. The actuating arm 42 includes a cantilevered corrugated leaf spring 60 that is integrally molded with the actuating arm 42. The locking mechanism 40 further includes an actuator 62 that is fixed to, for example, integrally molded with the actuating arm 42. The actuator 62 extends laterally from one end of the actuating arm 42. The other end of the actuating arm includes a recessed portion 64 in which a through hole 66 is formed.

The lever member 44 includes a tubular portion 68 from which two arms 70A, 70B extend. The two arms 70A, 70B are angularly spaced apart from each other. They may be perpendicular to each other as shown in FIG. 11 but can also be spaced for example anywhere between 45° to 135° apart. Located at the free end of each of these arms 70A, 70B is a pin 72 that extends in a direction parallel to a longitudinal axis of the tubular portion 68. The latch 46, in one embodiment, is a rectangular shaped block having a recessed bifurcated end 73. The latch 46 includes a V-shaped recessed portion 74 in which a rectangular slot 76 (FIG. 6) is formed.

During assembly of the locking mechanism 40 to the first tray portion 4, the actuating arm 42 is inserted through an opening 80 in the outer wall 12 of the first tray portion 4 at an appropriate angle to the sidewall 10A so that the recessed portion 64 of the actuating arm 42 clears a protrusion 81 extending from the sidewall 10A. After a certain length, for example half or three-quarters of the length, of the actuating arm 42 is inserted through the opening 80, the actuating arm 42 is tilted towards the sidewall 10A to be seated between a pair of guide rails 82. Thereafter, the actuating arm 42 is slid along a channel defined between the pair of guide rails 82 until the actuator 62 abuts the end of the sidewall 10A. In this position, the actuator 62 is completely accommodated within the outer wall 12 with an exposed surface of the actuator 62 substantially flush with an exterior surface of the outer wall 12. The actuator 62 may however be only partially accommodated within the outer wall 12 or even outside but adjacent the outer wall 12. The actuator 62 is located away from a medial portion of the outer wall 12 to be off-centered, more specifically the actuator 62 is located at a corner of the first tray portion 4, so as to avoid unintentional actuation.

Also, in this position of the actuating arm 42, the recessed portion 64 extends beyond the ends of the pair of guide rails 82. The ends of the pair of guide rails 82 include two oppositely facing protrusions 84 to confine sliding movement of the actuating arm 42 between the guide rails 82. In this position of the actuating arm 42, a pair of tweezers or long-nose pliers may be used to pick the free end 86 of the corrugated leaf spring 60, compress and anchor it to the protrusion 81. In some embodiments, the actuating arm 42 may alternatively be biased by a coil spring (not shown) that is placed in the slot 58 with an end thereof abutting an end of the slot 58 of the actuating arm 42 and compressed to bias the actuating arm 42 to its extended position. In other embodiments, either a coil spring or a leaf spring (both not shown) may be used to directly bias the latch 46 instead.

The latch 46 is similarly slid on the sidewall 10A along a channel defined by a respective pair of spaced apart loop retainer guides 90. When coupled to the second tray portion 6, the rail 50 is received between the pair of loop retainer guides 90. A T-shaped projection 92 that extends from the sidewall 10A defines an end of the channel. Next, the lever member 44 is pivoted to the sidewall 10A via the pivoting pin 58 such that pins 72 are positioned in the hole 66 of the actuating arm 42 and the rectangular slot 76 of the latch 46 respectively to thereby link the actuating arm 42 and the latch 46.

Advantageously, the first tray portion in accordance with the above-disclosed embodiments embodies the invention is compact in size, easy to operate and provides a firm lock with a second tray portion. Furthermore, although the present invention is described as implemented in the above-described embodiments, it is not to be construed to be limited as such. For example, the locking mechanism may alternatively be implemented with the actuating arm 42 slidably mounted to the base 13 of the first tray portion 4 instead.

Figure 13:
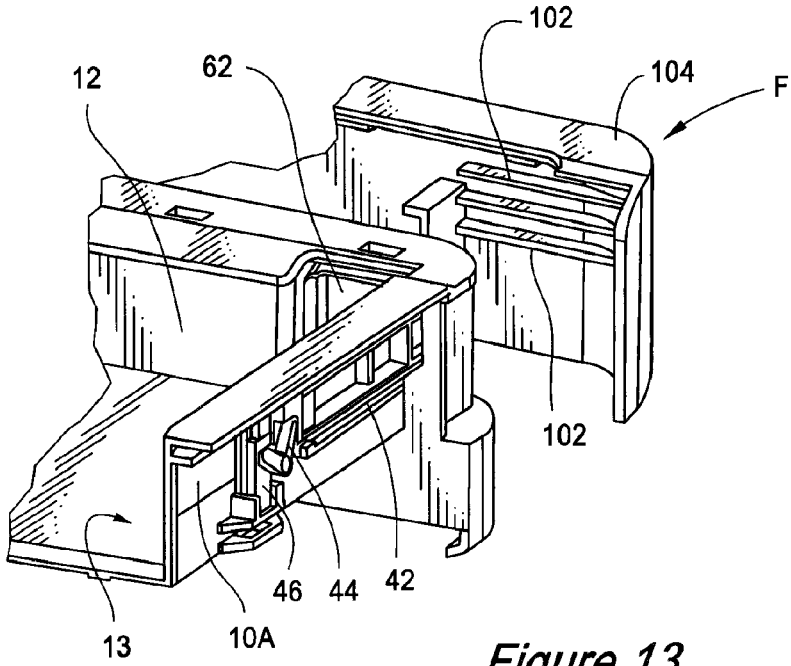
FIG. 13 is an isometric drawing of a first tray portion, according to another embodiment of the invention.
Figure 14:
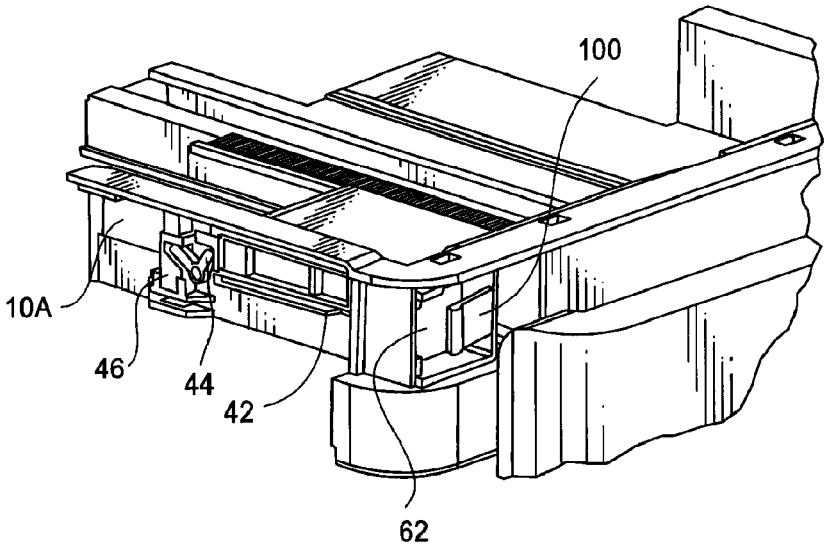
FIG. 14 is an isometric drawing of the first tray portion in FIG. 13 as viewed in the direction of the arrow F shown in FIG. 13.

As amother example, the actuating am 42 may be indirectly biased by biasing the actuator 62 using either a coil spring (not shown) or a leaf spring 100 as shown in Figures 13 and 14. The free end of the leaf spring 100 abuts ribs 102 on a cover plate 104 snap fitted to the outer wall 12.

As yet another example, the first tray portion may be coupleable directly to a corresponding tray portion that is fixed to an image forming device. Accordingly, an image forming device according to another embodiment includes the first tray portion. The first tray portion is coupleable to a second tray portion, wherein the second tray portion may be received into the image forming device or fixedly attached thereto.

As yet a further example, the first tray portion may also be used as a back cover of an image forming device which may be extended to provide media jam clearance access to the device.

Figure 15:
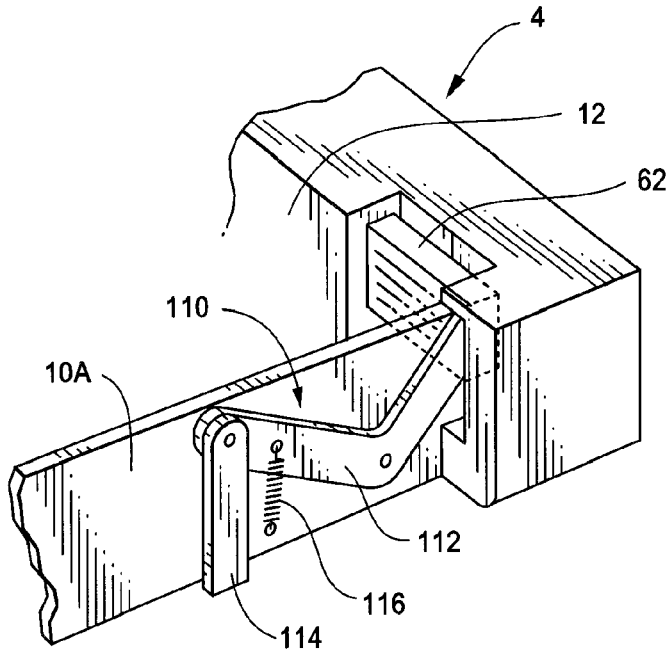
FIG. 15 is an isometric drawing of a first tray portion having a locking mechanism according to an alternative embodiment of the invention.

FIG. 15 shows a first tray portion 4 having a locking mechanism 110 according to an alternative embodiment of the invention. The locking mechanism 110 includes an actuating lever 112 that is pivotably mounted to a sidewall 10A of the first tray portion 4. A handle 62 is fixed to one end of the actuating lever 112. The handle 62 is positioned at least substantially parallel to and close to an end or outer wall 12 of the first tray portion 4 adjacent the sidewall 10A. A latch 114 is pivotably attached to the other end of the actuating lever 112. The actuating lever 112 is biased using a coil spring 116 to place the latch 114 in a locked position. Alternatively, the actuating lever 112 may be gravitationally biased. With such an arrangement, the handle 62 may be pulled towards or into the outer wall 12 to actuate the locking mechanism 110 by moving the latch 114 to an unlocked position.

Figure 16:
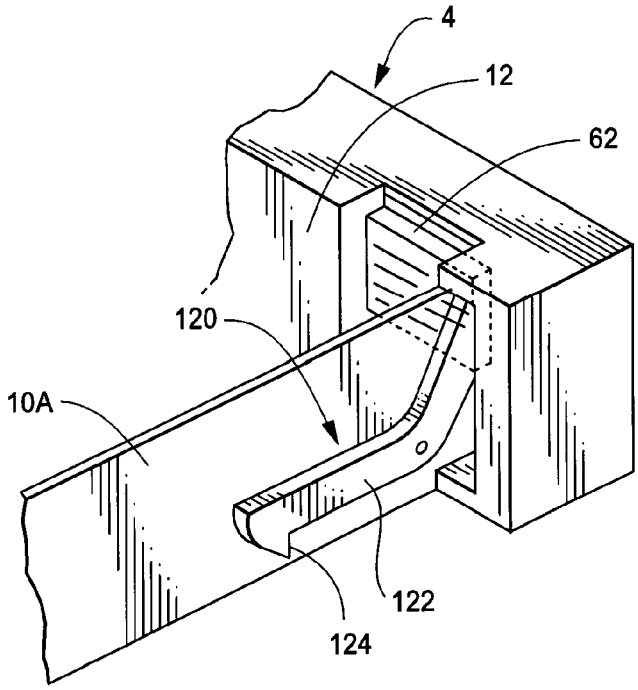
FIG. 16 is an isometric drawing of a first tray portion having a locking mechanism according to yet another embodiment of the invention.

FIG. 16 shows a first tray portion 4 having a locking mechanism 120 according to yet another embodiment. The locking mechanism 120 includes an actuating lever 122 that is pivotably mounted to a sidewall 10A of the first tray portion 4. At one end of the actuating lever 122 is a pawl 124 that engages a ratchet rack (not shown) of a second tray portion.

What is claimed is:

1. A media tray for holding a stack of media comprising:

a first tray portion having a first base, an end wall, and two opposing sidewalls flanking the end wall;

a second tray portion coupled to said first tray portion, said second tray portion having a second base, and two opposing side guides configured to receive the sidewalls of the first tray portion, the sidewalls of the first tray portion being slidable along the side guides of the second tray portion so as to allow the first tray portion to move relative to the second tray portion to thereby adjust an area for accommodating the stack of media; and a locking mechanism configured to lock the position of the first tray portion relative to the second tray portion at different positions, said locking mechanism comprising: (a) an actuating arm moveably mounted to one sidewall of the first tray portion; (b) a latch moveably coupled to said one sidewall of the first tray portion so as to be moveable between a locking position and an unlocking position; (c) a lever member pivotally mounted to said one sidewall of the first tray portion and configured to link the actuating arm to the latch; (d) an actuator fixedly attached to one end of the actuating arm and positioned adjacent to a corner formed between the end wall and said one sidewall of the first tray portion; and (e) a plurality of spaced-apart notches formed in the second tray portion and configured to engage the latch, wherein the actuating arm is normally spring-biased against the lever member to thereby bias the latch in a locking position, in which the latch engages one of the notches, and the actuating arm is moveable away from the latch upon actuating the actuator to thereby cause the latch to disengage from the notch.

2. The media tray of claim 1, wherein the actuating arm is moveable between an extended position and a retracted position, whereby the actuating arm is normally spring-biased to its extended position to cause the latch to be biased in the locking position, and the actuating arm is moveable to its retracted position when the actuator is actuated to cause the latch to disengage from the notch.

3. The media tray of claim 2, wherein the actuating arm is biased to its extended position by a corrugated leaf spring fixed to the actuating arm.

4. The media tray of claim 1, wherein the actuator is partially accommodated within the end wall of the first tray portion.

5. The media tray of claim 1, wherein the actuator is accommodated within the end wall of the first tray portion such that an outer surface of the actuator is flush with an exterior surface of the end wall.

6. The media tray of claim 1, wherein the actuator is configured so that it can be actuated by pressing on the actuator.

7. The media tray of claim 1, wherein the actuating arm is moveable along a first movement axis that is parallel to said one sidewall of the first tray portion, and the latch is moveable along a second movement axis that is traverse to said first movement axis.

8. The media tray of claim 1, wherein the actuating arm is indirectly biased by a spring in biasing contact with the actuator.

9. The media tray of claim 1, wherein the second tray portion further comprises a rail positioned adjacent to and parallel to said one sidewall of the first tray portion, and the notches are located along said rail.

10. A media tray for holding a stack of media comprising:

a first tray portion having a first base, an end wall, and two opposing sidewalls flanking the end wall;

a second tray portion coupled to said first tray portion, said second tray portion having a second base, and two opposing side guides configured to receive the sidewalls of the first tray portion, the sidewalls of the first tray portion being slidable along the side guides of the second tray portion so as to allow the first tray portion to move relative to the second tray portion to thereby adjust an area for accommodating the stack of media; and a locking mechanism configured to lock the position of the first tray portion relative to the second tray portion at different positions, said locking mechanism comprising: (a) an actuating arm moveably mounted to one sidewall of the first tray portion; (b) a latch linked to said actuating arm and coupled to said one sidewall of the first tray portion so as to be moveable between a locking position and an unlocking position; (c) an actuator fixedly attached to one end of the actuating arm and positioned adjacent to a corner formed between the end wall and said one sidewall of the first tray portion; and (d) a plurality of spaced-apart notches formed in the second tray portion and configured to engage the latch, wherein the actuating arm is normally spring-biased to thereby bias the latch in a locking position, in which the latch engages one of the notches, and the actuating arm is moveable away from the latch upon actuating the actuator to thereby cause the latch to disengage from the notch.

11. An imaging device comprising a media tray for holding a stack of media, said media tray comprising:

a first tray portion having a first base, an end wall, and two opposing sidewalls flanking the end wall;

a second tray portion coupled to said first tray portion, said second tray portion having a second base, and two opposing side guides configured to receive the sidewalls of the first tray portion, the sidewalls of the first tray portion being slidable along the side guides of the second tray portion so as to allow the first tray portion to move relative to the second tray portion to thereby adjust an area for accommodating the stack of media; and a locking mechanism configured to lock the position of the first tray portion relative to the second tray portion at different positions, said locking mechanism comprising: (a) an actuating arm moveably mounted to one sidewall of the first tray portion; (b) a latch linked to said actuating arm and coupled to said one sidewall of the first tray portion so as to be moveable between a locking position and an unlocking position; (c) an actuator fixedly attached to one end of the actuating arm and positioned adjacent to a corner formed between the end wall and said one sidewall of the first tray portion; and (d) a plurality of spaced-apart notches formed in the second tray portion and configured to engage the latch, wherein the actuating arm is normally spring-biased to thereby bias the latch in a locking position, in which the latch engages one of the notches, and the actuating arm is moveable away from the latch upon actuating the actuator to thereby cause the latch to disengage from the notch.

12. The imaging device of claim 11, wherein said locking mechanism further comprises a lever member pivotally mounted to said one sidewall of the first tray portion and configured to link the actuating arm to the latch such that the actuating arm is normally spring-biased against the lever member to thereby bias the latch in a locking position.

13. The imaging device of claim 11, wherein the second tray portion is fixed to the imaging device.

* * * * *